United States Patent [19]

Ross

[11] 4,014,392

[45] Mar. 29, 1977

[54] STABILIZED PISTON-CYLINDER IMPACT DEVICE

[76] Inventor: Frederick W. Ross, 755 Klamath Drive, Del Mar, Calif. 92014

[22] Filed: Dec. 19, 1974

[21] Appl. No.: 534,626

Related U.S. Application Data

[63] Continuation of Ser. No. 337,127, March 1, 1973, which is a continuation-in-part of Ser. No. 95,008, Dec. 4, 1970, abandoned.

[52] U.S. Cl. ..... 173/118; 74/583; 173/117; 173/122; 173/139; 173/162

[51] Int. Cl.[2] ..... B25D 11/16

[58] Field of Search ..... 173/116, 118–122, 173/124, 117; 74/583; 60/542

[56] References Cited

UNITED STATES PATENTS

| | | | |
|---|---|---|---|
| 973,216 | 10/1910 | Rowe | 173/117 |
| 1,052,823 | 2/1913 | Irvine | 173/118 |
| 1,191,948 | 7/1916 | Coates | 173/118 |
| 1,813,087 | 7/1931 | Sandage | 173/118 X |
| 2,447,886 | 8/1948 | Worth | 173/117 X |
| 3,497,017 | 2/1970 | Goettl et al. | 173/122 X |
| 3,559,751 | 2/1971 | Yamada | 173/116 |
| 3,688,848 | 7/1972 | Vick | 173/116 |
| 3,741,559 | 6/1973 | Ross | 267/124 |

FOREIGN PATENTS OR APPLICATIONS

| | | | |
|---|---|---|---|
| 700,794 | 11/1940 | Germany | 173/118 |
| 2,124,013 | 11/1971 | Germany | 173/118 |
| 348,271 | 5/1931 | United Kingdom | 173/118 |

*Primary Examiner*—Ernest R. Purser
*Assistant Examiner*—William F. Pate, III

[57] ABSTRACT

A power driven crankshaft is mounted on a frame and is connected by a pair of connecting rods to a coupler body, having guide means thereon to limit movement of the body to straight line reciprocation. Selected positioning and arrangement of crankshaft, bearings, connecting rods, journals, wrist pins, power drive means, reciprocating body guide means and selected crankarm result in high impact force being delivered to an impact tool with significantly reduced energy loss caused by oscillatory structural deflections spurious vibrations, and rotations. An improved coupler incorporates an air spring with selected central vent means resulting in nearly constant spring stiffness.

34 Claims, 13 Drawing Figures

INVENTOR.
FREDERICK W. ROSS
BY Carl R. Brown
ATTORNEY

INVENTOR.
FREDERICK W. ROSS

BY Carl R. Brown

ATTORNEY

STABILIZED PISTON-CYLINDER IMPACT DEVICE

REFERENCE TO OTHER APPLICATIONS

This application is a continuation of application Ser. No. 337,127, filed Mar. 1, 1973, which in turn was a continuation-in-part of application Ser. No. 95,008, filed Dec. 4, 1970, now abandoned.

BACKGROUND OF THE INVENTION

Demolition hammers and other such impact devices have been utilized for many years to deliver impact blows to an impact tool for the purpose of breaking up paving materials and other related activities requiring impact blows. Prior art impact devices utilizing high powered air compressors can be described as using the brute force approach to delivering impact blows. The requirement for a large compressor limits their mobility and access to many areas. In addition, the noise from the large air compressor and air exhausted from the air driven hammer is excessive and the fumes from the large internal combustion engine add to air polution.

Rotating shaft driven hammers such as electric motor hammers have failed to overcome all of the deficiencies related to the use of air compressor devices. Electric motor hammers of the prior art have had a relatively short service life and are not capable of delivering high power impact blows. In such prior art devices, the structure must be sufficiently light so that the device may be handled and manipulated manually. Yet, the presently devised light structures cannot carry the higher loads necessary to convert this power to performance. Accordingly, the current practice is to restrict the performance to a small fraction of what could otherwise be obtained so that the device will have a reasonably long service life. Further, the power efficiency of currently available devices is extremely low. In a typical impact device, only 10% of the power input to the device is actually utilized in breaking concrete.

Prior art devices utilizing a rotary shaft drive for the exciter means may be represented as being one of two types.

In the first type, the drive motor is a relatively large portion of the mass of the frame and its attachments and is mounted offside from the line of action of the main reaction force which drives the ram or piston to accomplish the impacting. In such arrangements the center of mass of the frame and attachments secured thereto are not aligned with the reactive force from the impacting piston. During operation, the high magnitude of these oscillating reactive forces induces extraneous oscillating torques that cause extraneous rotations of the frame as a whole as well as extraneous deflections and vibrations in the structure itself. These extraneous motions dissipate considerable power and shorten service life unnecessarily.

In the second arrangement common in prior art devices, the motor is not offset, but the mechanism including gears and their shafts, which carry the high reactive oscillating forces, must be supported by the supporting frame. The supporting frame is relatively light of necessity and hence is resilient to these oscillating forces. This arrangement also induces extraneous and undesirable forces and torques in the crank arm, shaft, and its support, which are for all prior art device, unsymmetrically located relative to the line of action of the main reactive force from the impacting piston.

With both common prior art arrangements then, the high reactive oscillating force which is oscillating or impacting against the resilient supporting frame causes it to oscillate and deflect in numerous complex and high magnitude motions. Furthermore, such oscillatory deflections in the supporting frame will "reflect" back onto the driving mechanism in such a way as to complicate the motions and forces further.

In prior art devices, the standard analytical procedures failed to take adequate account of the extraneous or secondary effects. With this approach, the value of the oscillating force can be represented by $$F_r = A_o \sin 2\pi ft \qquad 1.$$

where $A_o$ is the maximum amplitude, $t$ the time in seconds, and $f$ the frequency of the oscillatory force in cycles per second.

In fact, however, because of the presence of the extraneous effects as described above, the actual oscillating force is not this simple sinusoidal relation, but rather is more correctly represented by a series of functions such as $$F_r = A_o \sin 2\pi ft + A_1 \sin 4\pi ft + A_2 \sin 6\pi ft + \ldots \qquad 2.$$

This equation is what is referred to in mathematics as a Fourier series and constitutes a frequency analysis of the actual wave form of the reactive force. A typical experimental curve is shown in FIG. 9. This curve shows the time variation of the force at one point of a typical structure under the action of a typical oscillating force. The curve for the structure motion or deflections is generally similar in shape to that of the force itself.

According to Equation 2, in addition to the fundamental component, that is the first term only, which is represented as in Equation 1, there are present many other oscillation frequencies. Each of these has an amplitude ($A_i$) or magnitude that is induced by and determined by the factors discussed above.

Whereas an exact representation of the curve for any particular device will be dependent upon the mass distribution of the components and frame as well as their size, shape and elasticity of the material of which they are constructed, it is sufficient to note that the larger the disturbing causes such as offsets and asymmetries of components and their supports, and the necessity to support these in the frame as discussed above, the larger the amplitudes ($A_i$) of these components in both force and deflections.

While these additional forces are referred to as extraneous and asecondary, they are actually of utmost importance. The importance of these extraneous effects becomes apparent when it is observed relatively how much power is dissipated by them. These forces include all the vibrations except those represented by the first term of Equation 2 and they do no work but shake the frame and its components as well as the operator. The power dissipated by a vibration is proportional not only to its amplitude and its dissipation constant, but also to the cube of its frequency. Therefore, it becomes apparent that these higher frequency extraneous vibrations can be a source of much power loss and much damage to the structure.

For example, in one instance experimentally observed by an oscilloscope, one component, the sixth harmonic, stood out. It had an amplitude of only 10% of the fundamental, but its frequency was six times as high. Accordingly, if the ratio of dissipation factor on this harmonic is only 10% of the dissipation factor on the fundamental, the power lost through it by dissipation from this harmonic is $0.1 \times 0.1 \times 6 \times 6 \times 6$, or 2.16. In other words, there is over twice as much power dissipated through this "extraneous" vibration as is dissipated in the device accomplishing the work it was intended to do.

This analysis represents only one component and frequently numerous such components exist with frequencies from twice, to many times that of the fundamental. These extraneous forces build up such large power losses and tend to heat up the bearings causing fatigue in the linkage and supports as well as health damage to the operator.

The problem is compounded in prior art devices in that the undesirable disturbances are increased through the relatively short length connecting rod utilized. In these devices the linear acceleration, $a$, of the cylinder in its reciprocal action if the crank arm were rotating uniformly would be given by the expression $$a = w^2 r_c \cos wt + \text{secondary terms} \qquad 3.$$

where $w$ is the angular frequency in radians per second and $r_c$ is the crank arm radius. The first term in this equation would produce a reaction force such as is given by Equation 1 discussed hereinbefore. The secondary terms decrease when the ratio $L/r_c$ of connecting rod length to crank arm radius is large. The effect of these secondary terms is to add harmonic components to the fundamental given by the Equation 1 as discussed before in connection with Equation 2 and to introduce lateral forces of an amplitude proportional to the ratio $r_c/L$ times the reaction force. Both of these effects are insignificant in the ratio $L/r_c$ is greater than 6. In substantially all prior art devices this ratio is less than 6.

Most prior art devices utilize a piston cylinder to cushion the impact of the tool bit in the mechanism. Frequently two circumferential rings of vents on the cylinder are utilized with the vents located with one ring located a distance equal to approximately one third of the cylinder length from one end of the cylinder and a second ring of vents equally spaced from the other end of the cylinder. In particular, the two rings are spaced apart a distance greater than the length of the piston in the axial direction where the piston bears against the cylinder.

A second approach utilized in prior art devices incorporates a series of vents or slots serving the same purpose and extending approximately along the middle one third of the cylinder length. The length of these series of vents or slots is also somewhat greater than the length of the piston. The typical function of these slots or vents is the act as a bypass between the trapped air at opposite ends of the cylinders so that the pressure therein is maintained at approximately the same value. Only after the piston closes off the vents entirely at the extremes of its travel is the air entrapped and compressed to serve as a cushion so that the piston will not impact by direct metal contact with either cylinder end. To accomplish this purpose, considerable open area for the vents and considerable air flow is required. Much power is dissipated in producing such air flow and when the piston is passing between the rings of the vents or extremes of the slots, the piston is slowed down, since the energy needed for the pumping and for friction is taken from the pistons' kinetic energy. Accordingly the velocity at impact of the piston shaft on the bit is lowered, reducing the effectiveness of the impact.

As the piston closes the vent at one end, a mass of air with an initial volume of about one third of that of the entire cylinder, is entrapped in that end and forms a cushion to soften the blow between the piston and cylinder end as the piston is decelerated and given a reverse velocity. Since the velocity reversal and downward acceleration necessary for inducing the high impact by the foregoing arrangement must be carried out in somewhat less than one third of the cylinder length, the piston can only compress the entrapped gas which constitutes the cushion in about one half to two thirds of this remaining length, or less than about one sixth or two ninths of the total cylinder length. Accordingly, there will be a force induced on the piston which varies with its travel relative to the cylinder length. Curve A in FIG. 10 is typically representative of this force relationship. The piston travel is shown in terms of a cylinder length $h$. This is the total average open height of the cylinder on one side of the piston. $h$ equals the open volume V on that side of the piston divided by the piston area A. $x$ is the actual piston excursion. $x/h$ is 0 when the piston excursion is 0 at the point of zero force and 1.0 if the piston were to move so that the remaining volume on that side toward which it is displaced were 0. $h$ is usually the same on each side of a double acting air spring.

A third prior configuration makes use of a long piston. With this configuration, as little as 5% of the cylinder initial volume is available for deceleration of the piston at the end of each stroke. Such high deceleration results in high cylinder pressures, as high as 20–25 atmospheres, and results in a very sharp peak in the force curve; therefore transferring high forces to the mechanism and frame and using a high ratio of piston excursion to total open cylinder length. Such ratio expressed, as a function of piston excursion $x$ to cylinder length $h$ is illustrated as curve B in FIG. 10.

Prior art devices therefore must operate on the curves such as A and B and therefore reach $x/h$ ratios in excess of 0.7 to obtain the high return force necessary to decelerate the piston in the minimal distance provided. Operation in this range produces high harmonics such as are identified in Equation 2 and therefore places severe loads on the bearings and structure, passing along sharp reaction forces to the operator holding the equipment, and causing severe heating and heat losses. The characteristics of prior art devices are understandable in that the piston-cylinder is intended to provide an air cushion rather than to provide other functions, and is inherent in the basic gas law equation $$FV^n = AP_iV_i^n \qquad 4.$$

where $A$ is the piston area, $P_i$ is the initial pressure and $V_i$ is the initial volume of the piston, and $n$ is a constant of value approximately 1.3. Assuming the normal thermo-dynamic relation would obtain where $$T_2 = T_1 (P_2/P_{P1})^{(n-1)/n} \qquad 5.$$

and $T_1$ is the ambient temperature in degrees absolute, $T_2$ is the final temperature, for a typical example with a compression ratio $P_2/P_{P1}$ of 25 the temperature would rise to approximately 323° C above ambient temperature. While this high temperature occurs only at the peak of compression, and the time average over the cycle of operation would be somewhat less, this average is still a very high value. The heat and consequent power loss by radiation and conduction will be considerable and hence the power efficiency of operation will be lowered accordingly, and the piston cylinder will heat up introducing difficult lubrication and materials problems.

Due to the aforedescribed deficiencies of prior art devices, an improved impact device is much sought after. Thus it would be advantageous to have an impact device with greater portability than prior art devices, and one having the capability of delivering heavy impact blows more efficiently and effectively with much reduced noise levels and with reduced air polution. Additionally, it would be advantageous to have a device which delivered less harmful oscillations or vibration to the operator and one which is less susceptible to breakdown in service.

SUMMARY OF THE INVENTION

An exemplary embodiment of the invention incorporates a new combination of main frame design and of the relative location of the attachments thereto which constitutes an integral balanced symmetric design together with a new excitation means and convertor means in which the principal reaction forces experienced by the frame and working unit are aligned and maintained within the mechanism itself to substantially eliminate important disturbing forces and moments, and the incorporation of a double acting air spring referred to as a piston cylinder means between the power source or exciter means and the impact means which includes the impact tool. The air spring is utilized to couple the output of the exicter means, which in the exemplary embodiment takes the form of a rotary electric motor. It is possible to drive either the piston or the cylinder with the exciter means, however, for purposes of simplicity, the exicitation of the cylinder by the motor is used exclusively in the illustrations of this application. The rotary output of the motor is changed to linear motion by a convertor means which in the exemplary embodiment takes the form of dual eccentrics mounted on opposite sides of the motor and the motor drive shaft and connecting rods from the eccentrics to bearings supported on the cylinder. The cylinder is mounted so that it may slidably move in response to the force induced through the connecting rods and is constrained to linear motion by guides mounted on the frame of the device. A piston shaft attached to the piston protrudes from one end of the cylinder into proximity with the output means that carries the impact tool. The spacing between the piston shaft and the output means is such that the piston shaft makes contact with the output means at the lower end of each piston stroke. The mechanism as described with double eccentries directly driving the cylinder in oscillation and with a piston coupled only through the air spring of the piston-cylinder combination offers an integral design without gears that is rugged and inexpensive. The direct drive without gears requires a slower speed motor, but this added weight in many applications is less than that removed by the elimination of gears. The cost is also less and the serviceability is much better, especially on an impact device where oscillatory loads shorten gear life.

Thus, in this embodiment of the invention, the oscillating reaction force is carried directly and symmetrically from the cylinder to the rotational drive shaft by two connecting rods 200 as in FIG. 11, each connected through an anti-friction bearing, shown in the form of a ball bearing, to a crank arm represented by an eccentric 202 wherein the respective crank arms are rotationally located on the output shaft 204 in the same rotational phase. Further, the bearings 210 supporting the shaft 204 on the frame 220 are each located in close proximity to the respective eccentric and symmetrically with respect to the line of action of the resultant reaction force. Finally, the drive motor 208 and frame 220 are located between the shaft bearings respectively so that the resultant center of mass 206 of the entire frame and all components secured thereto is substantially in the line of action of the reactive resultant force. The connecting rods 200 are attached to the cylinder as by wrist pins 212 so that the axis of the cylinder lies substantially midway between the two connecting rods.

The force from the cylinder passes symmetrically through the connecting rods, directly to the rotating shaft, and thence directly and symmetrically to the frame and motor weight. There are no intermediate idler shafts or other mechanisms that must be supported by a resilient frame, such as are found on all state of the art devices. Thus the severe impacting loads induced by the oscillating cylinder 224 reaction do not pass through a devious route including the frame or auxiliary supporting bearings and an offset shaft and at relatively large lever arms from the center of mass, but rather remains integrally within the direct double linkage described. Accordingly, many of the sources of extraneous vibrations are eliminated and others reduced to relative insignificance.

The direct linking of both connecting rods 200 to the respective sides of the cylinder by wrist pins supported on the cylinder at a point located between the cylinder center and its longitudinal end which is more remote from the rotating shaft, rather than being connected to its near end helps to make possible a higher $L/r_3$ ratio. A secondary effect of this location is to stabilize the motion of the cylinder and the piston freely moving within it, since all larger reaction forces acting on the cylinder are in a direction tending to hold the cylinder in alignment on its sliding supports rather than at an angle thereto. The use of short crank arms (diagrammatically illustrated at 240) also contributes to the higher $L/r_c$ ratio and these short crank arms are, in turn, made possible by the use of dynamic amplification as described more fully hereinafter.

The mean oscillatory point of the piston within the cylinder is stabilized through the use of a single vent or single ring of vents 246 near the cylinder mid-length. If more than one ring of vents is used, the rings are spaced on either side of a point near the cylinder mid-length, and by a distance less than the length of the piston where it bears against the cylinder. The vents 246 are sized so as to be effective only to balance the quantity of air at opposite ends of the cylinder, and not significantly effect the motion of the piston within the cylinder. For this reason, the piston is active substantially throughout the oscillation and pressure build-up begins immediately after the departure of the piston from the mid-cylinder point. The curve C in FIG. 10 is typical of the force versus displacement ratio of the piston in devices according to the invention. Typically, an $x/h$ ratio of 0.7 is not exceeded in normal operations, and therefore the piston is operating in the nearly linear portion of the exponential function. The purpose of the force on the piston is to stop piston motion in one direction and reverse it, and then increase it in the opposite direction. Since the area under the force curve represents the stopping capability and as can be seen, as in FIG. 10, all of the curves substantially have an equal area under them, the maximum force necessary to stop the piston in embodiment of the invention operating according to the curve C, is less than half of that for curve A and approximately one third of that of curve B. The more gradual force application experienced with devices incorporating the invention results in a lower transmittal of extraneous forces to the supporting structure as well as much lower temperature increases.

To maximize the nearly doubling effect of an air spring operated in the range typified by curve C in FIG. 10, the stabilizing vents are made as small as possible while still serving the stabilization function desired. This is so that the negative pressure on the retreating side of the piston may be as effective as possible in contributing to the air spring effect. Therefore maximum advantage of the stabilization system is made with the vents no more than three times the area of clearance between piston and cylinder. These vents serve only to leak alternately enough air into the low pressure volume side of the air spring to maintain the piston excursion within the confines of the cylinder end so that the piston will impact the anvil or tool at the correct phase of its oscillation and will not impact the other end of the cylinder. The use of small area vents contributes much more than would be expected by the knowledge generally known in the field. Not only do they serve to stabilize the piston motion, they do this (because they are so small and located substantially about the mid-excursion point) without substantially reducing the doubling action effect of the double air spring. The large vents utilized in prior art devices even if placed like those in the instant invention would effectively reduce the stiffness of the air spring substantially in half. Therefore, a much larger cylinder would be required to give the same stiffness resulting in a prohibitive penalty in weight and/or performance.

A maximized utilization of the precepts of the invention is made when use is made of the principles of dynamic amplification. The various components are sized so as to operate in the range of dynamic amplification at the operating frequency of the exciter means.

A typical operation of the invention is as follows:

The oscillation of the cylinder induced by the rotating shaft, crank arm and connecting rods is approximately sinusoidal. Relatively long connecting rods and short crank arms, together with dynamic amplification, contribute to improve considerably the approximation to sinusoidal motion. The reciprocating oscillation of the cylinder communicates through the cylinder ends a forced oscillation on the air spring ends which in turn induces forced oscillation on the piston shaft mass. At steady state condition, the piston shaft strikes the anvil at a relatively high impact velocity thereby delivering a high impact blow to the anvil or bit, and giving up most of its kinetic energy of approach. Next the piston shaft rebounds at a lower rebound velocity ranging from nearly zero to on the order of one half of the impact velocity. The rebound velocity is determined by the resilience or fracturing of the work being impacted as well as the resilience of the bit and piston shaft unit. During the very short time intervals from immediately before the impact to immediately thereafter, all the useful work done during the entire cycle is taken from the initial kinetic energy of the piston shaft unit, and transferred to the anvil and/or tool bit. During the remainder of the cycle of operation, the piston air spring behaves approximately like a linear spring mass system with a low value of damping coefficient, except that the cylinder half excursion, in order to be able to supply the power necessary for doing the impacting work, is much larger than would be necessary to maintain a normal value of piston excursion. Immediately after impact, the attributes of a linear system with low dissipation are available to gain the rapid recovery from the loss of energy after each impact. Thus, although the overall motion is highly non-linear, the factors that determine the dynamic amplification of simpler linear systems are still the underlying factors that lead to the net dynamic amplification of the non-linear system over the entire cycle.

It is therefore an object of this invention to provide a new and improved impact device.

It is another object of the invention to provide a new and improved impact device that delivers heavier impact blows than is possible with conventional devices.

It is another object of this invention to provide a new and improved impact device that is more portable and not dependent on heavy and expensive air compressor systems.

It is another object of this invention to provide a new and improved impact device which transfers less of the forces caused by vibration and oscillation to the operator.

It is another object of this invention to provide a new and improved impact device which incorporates the advantages of double acting air springs operating at resonance.

It is another object of this invention to provide a new and improved impact device where less of the forces associated with the reciprocating parts are transferred to the connecting portions and bearings.

It is another object of this invention to provide a new and improved impact device which is light in weight and simple in design leading to ease in use and low maintenance.

It is another object of this invention to provide a new and improved impact device utilizing a high strength piston design.

Other objects and many advantages of this invention will become more apparent upon a reading of the following detailed description and an examination of the drawings wherein like reference numerals designate like parts throughout.

BRIEF DESCRIPTION OF THE DRAWINGS

Referring now to FIGS. 1 through 5 there is illustrated a preferred embodiment of the invention. A piston-cylinder means 10 is mounted on a frame 12 which is rigidly attached to excitation means 14, in this embodiment an electric motor. At the opposite end of frame 12 from motor 14 is located the output means 16. The cylinder 10 comprises a barrel portion 18 together with end caps 20 and 22. End cap 20 includes bearing holes 24 and 26 and end cap 22 smilary contains bearing holes 28 and 30. These bearing holes cooperate with the frame 12 to restrain cylinder 10 to linear motion along the frame 12. The rotary output of motor 14 through shaft 32 is converted to linear motion through the eccentrics 34 and connecting rods 36. The connecting rods are secured to the end plate 20 by bearing supports 38 and pins 40. The linear motion induced in cylinder 10 causes piston 42 to begin to oscillate by the action of the air in cylinder 10. The piston shaft, which protrudes through a bearing hole 46 in end plate 20, transmits this piston oscillation. When the piston excursion reaches a certain value the end 48 of piston shaft 44 contacts the end 50 of tool bit holder 52, which causes the tool holder to move against the action of spring 54 and drive the tool bit 56 into the material upon which work is to be performed. The output means 16 constrains the tool holder 52 to linear motion by guide holes 58 in flange 60.

This embodiment of the invention employs as passive passage stabilization means in the piston-cylinder means a series of vent holes 62. These vent holes are located at the midpoint of cylinder 10 and are effective to balance the pressure between opposite ends of the cylinder, with piston 42 located near the midpoint, by venting alternate cylinder ends as the vents are unported by the oscillating action of piston 42.

Figure 1:
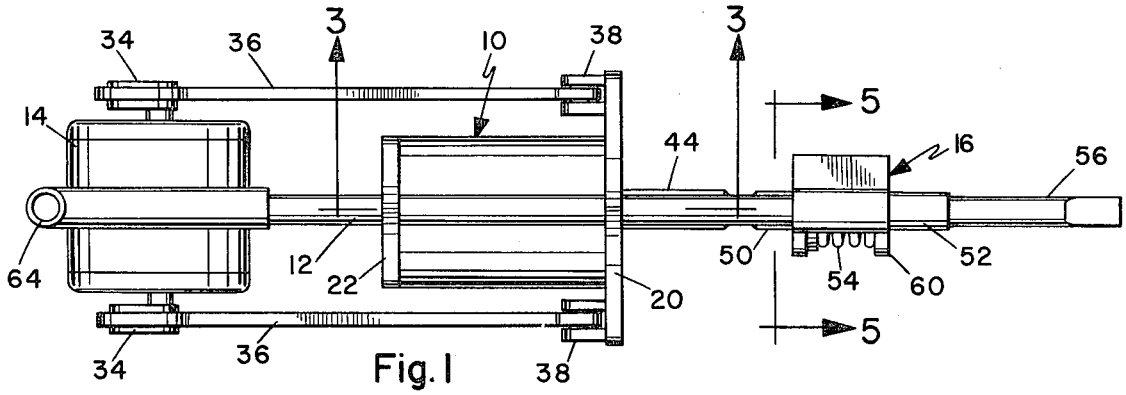
FIG. 1 is a side elevation view of the basic form of an impact tool.
Figure 2:
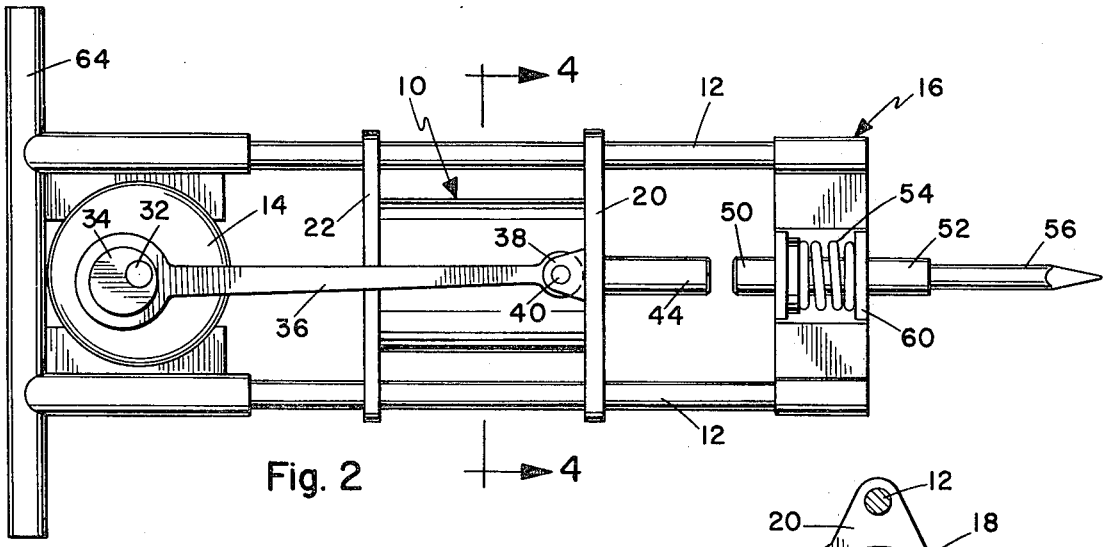
FIG. 2 is a top plan view of the device.
Figure 4:
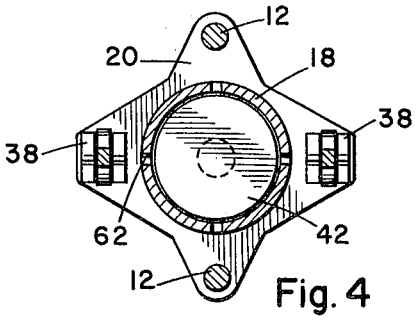
FIG. 4 is a sectional view taken on line 4—4 of FIG. 2.
Figure 3:
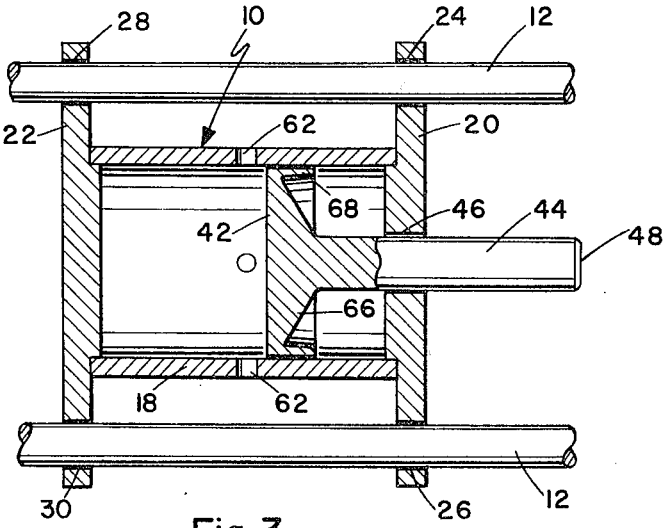
FIG. 3 is an enlarged sectional view taken on line 3—3 of FIG. 1.
Figure 5:
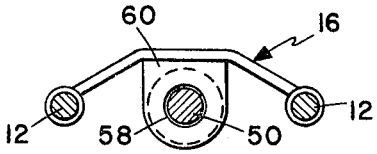
FIG. 5 is a sectional view taken on line 5—5 of FIG. 1.

FIG. 3 illustrates the unique high strength piston design of the invention. Such a high strength design is valuable since the impact of piston shaft 44 with the output means produces high stresses in the piston web 66. These stresses reach their maximum at the attachment to piston shaft. The piston design concentrates the piston mass near the piston shaft center line and the mass near the cylinder walls is kept at a minimum. Effective sealing is maintained through the use of a light weight depending flange 68.

It is useful to note that the motor 14 illustrated in conjunction with FIGS. 1 through 5 is indicated to be an electric motor. Any of many different types of electric motors will function properly with the invention including capacitor start or split phase induction motors, wound rotor motors with commutator, or universal electrical motors.

An induction motor is especially advantageous for this usage. The induction motor is substantially a constant speed motor which is an important advantage in maintaining less change in rotating speed for operation under differing loads. Thus the operating frequency is held more nearly constant and hence the condition between that and the natural frequency of the piston-cylinder means is better matched so that the dynamic amplification is more nearly constant. Such a motor has no brushes to wear, and more important, no brush supports to fail structurally because of fatigue caused by the relatively severe vibrations such a motor experiences. The split phase type of induction motor and the capacitor start capacitor run type have no brushes or supports to fail under such vibrations. The capacitor start induction run type does have a starting switch. But this is mounted on and rotates with the motor shaft and so that the vibrations caused by the main impact device frame oscillations only increase the centripetal loads on the switch slightly and hence are nearly as free from susceptibility of vibration failure. Finally, the vibrations filtering effect of the air spring, which mainly transmits only the basic operating frequency of the impacting back into the main frame, reduces the effects of the higher frequencies which are more destructive.

Further an internal combustion engine, hydraulic rotary motor, or any other portable device for producing rotary motion may be used in conjunction with the impact device of the invention.

Figure 6:
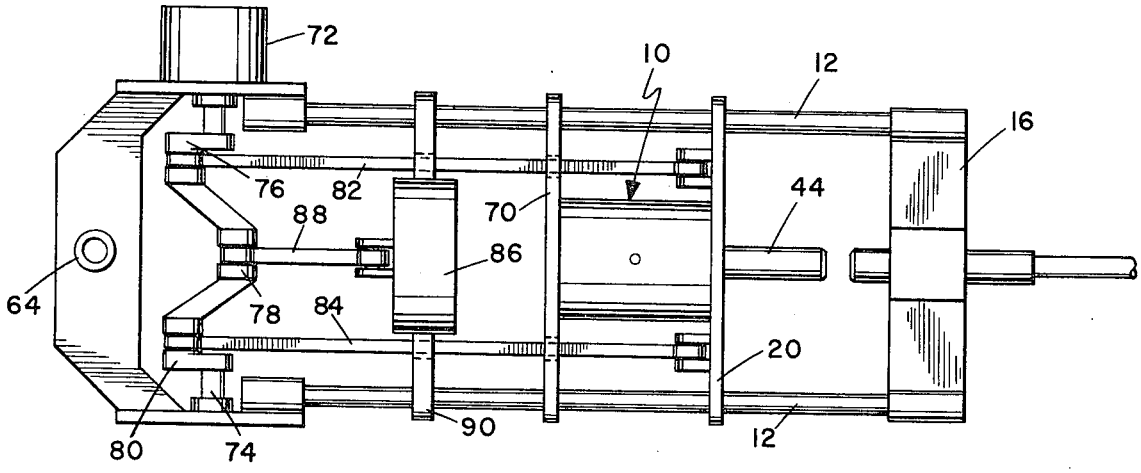
FIG. 6 is a side elevation view of an alternative form of device with counterbalancing.

FIG. 6 illustrates another embodiment of the invention. As in FIGS. 1 through 5, the embodiment of FIG. 6 incorporates a cylinder 10 with piston shaft 44 protruding and an output means 16 associated with the piston shaft. The cylinder is constrained to linear motion along frame 12 by end plates 20 and 70. However in this embodiment the motor 72 is offset from the center line and drives a crank shaft 74 which crank shaft has three cranks 76, 78, and 80. Cranks 76 and 78 operate together to drive cylinder 10 through connecting rods 82 and 84. Crank 78 is 180° out of phase with cranks 76 and 80 and drives counterweight 86 through connecting rod 88. Counterweight 86 is constrained to linear motion along frame 12 by guide plate 90. By selecting the total mass of the counterweight together with its associated guide plate 90 and connecting rod 88, to approximate the mass of cylinder 10 with its associated plates and connecting rods, the torque surges, which would otherwise be induced on the crank shaft 78 during rotation, can be much reduced. This promotes smooth overall operation and low vibration.

Figure 7:
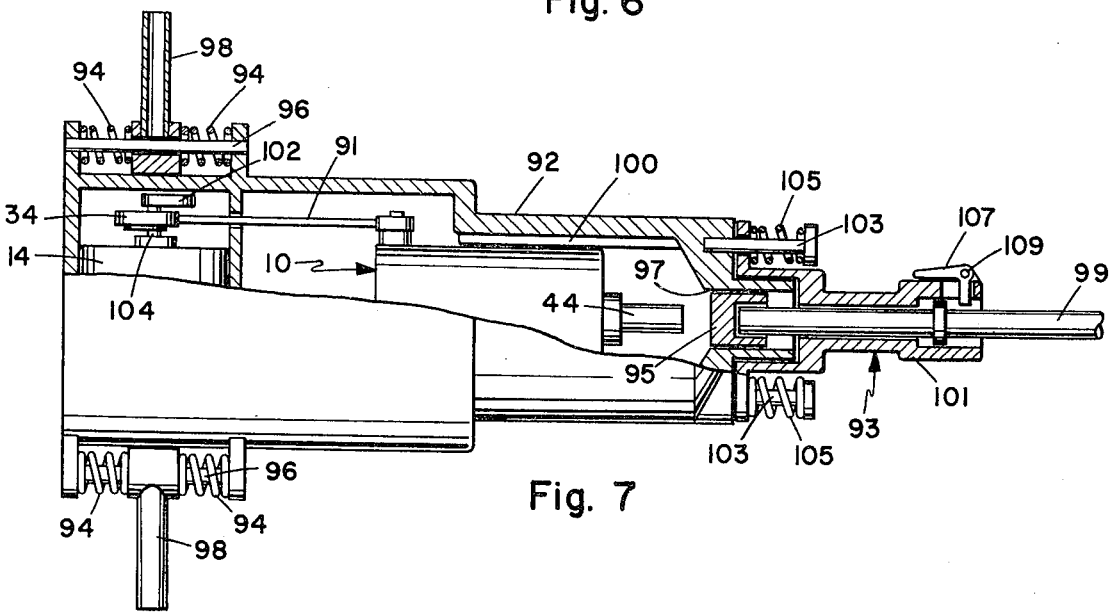
FIG. 7 is a top plane partially cut away, view of a further form of the device.

FIG. 7 illustrates a third embodiment of the invention. This embodiment utilizes a motor 14, eccentrics 34, cylinder 10 and connecting rods 91 similar to those disclosed with reference to FIGS. 1 through 5 except the tubular frame is replaced by a frame 92 which at the same time serves as an enclosing case. This embodiment also incorporates springs 94 supported on rods 96 which also support handles 98 to allow the handles to slide co-linearly with the axis of cylinder 10. By selecting the combined spring constant favorably springs 94 serve to isolate the handles from the vibrations of the main frame.

Also in this embodiment, cylinder 10 is free to reciprocate on sliders 100 which are attached to a cylindrical hollow in the frame. The slides 100 are positioned to not obstruct cylinder vents if employed. Counterweights 102 attached to motor shaft 104 serve to counterbalance the vibrations which would otherwise be induced by the off axis weights of the eccentric and attaching connecting rods.

Also illustrated in FIG. 7 is output means which incorporates an anvil 95 supported for reciprocating movement along a cylindrical opening 97 in frame 92. The anvil slidably receives tool 99 which is constrained to linear motion by tool holder guide 101. Tool holder guide 101 is slidably attached to pins 103 which, in turn, are attached to frame 92. The tool holder guide also acts as a spring biased stop with the action of springs 105 to prevent excessive loads on frame 92 for large excursions by piston shaft 44. The importance of the action of tool holder guide 101 as a stop will be more readily apparent from a discussion of FIG. 8. Retainer 107 releasably holds tool 99 in position. Retainer 107 may be rotated about pin 109 to permit removal of the tool.

Figure 8:
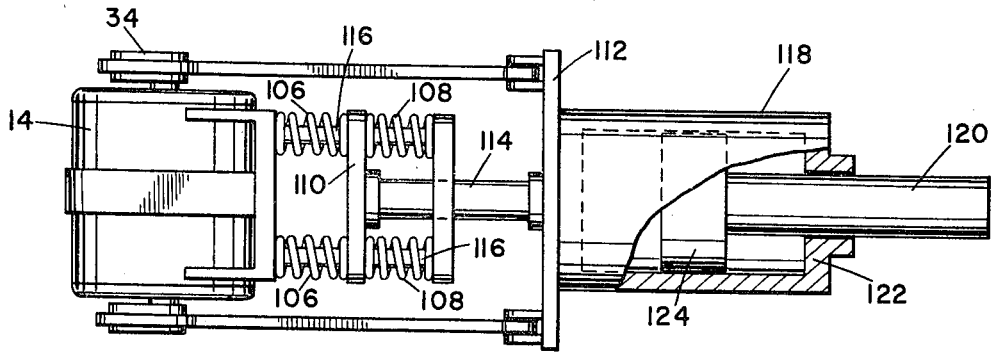
FIG. 8 is a side elevation view of an impact unit for installation in associated devices.
Figure 9:
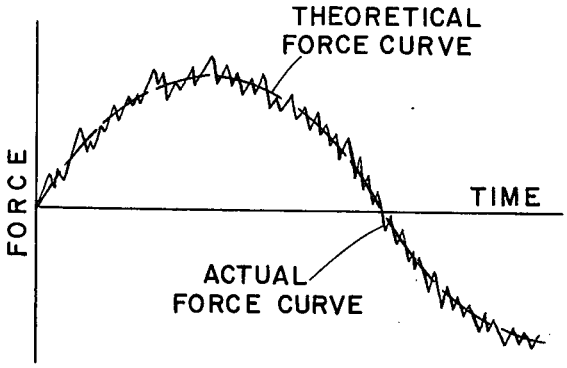
FIG. 9 is a graph of theoretical and actual reaction force.

FIG. 8 illustrates an embodiment of the invention in the form of an impact unit which may be utilized in association with impact apparatus described hereinbefore. The motor 14 and eccentrics 34 are identical to those illustrated in FIGS. 1 through 5. However the device incorporates an embodiment of the load compensating spring means. The Figure illustrates two spring means 106 and two spring means 108 mounted on either side of plate 110 which is rigidly affixed to the cylinder end plate 112 by shaft 114. These springs form a compensating means which functions as follows. As the connecting rod moves the motor frame and cylinder closer together, the springs 106 are compressed and as the connecting rods move the motor and cylinder further apart the springs 108 are compressed. When the combined spring constant of these springs is selected so that the natural frequency is near or a little above the operating frequency the action of these springs lightens the load on the eccentrics, rods and bearings.

Also illustrated in FIG. 8 is cylinder 118 which is illustrated to be unvented and therefore could be expected to experience piston oscillation mean point excursions with eventual impact against a cylinder end. However, this piston cylinder combinaton is designed in accordance with a second technique for compensating for piston oscillation instability. The piston shaft 120 is designed to take up a relatively large portion (in excess of 15 percent) of the half of cylinder 118 adjacent cylinder end 122. This size relationship dictates that the drift of the piston oscillation center will always be in the same direction, that is, toward end 122. This occurs because leakage past piston 124 in the direction from end 122 toward end 112 will have a greater effect on the pressure at that end, than flow in the opposite direction. With the unit of FIG. 8 employed with an impact device, the force translated through the tool by contact with the work piece will prevent the piston excursion from progressing to a point where piston 124 will impact end 122, or the unit may be used in conjunction with an output means such as is illustrated in FIG. 7 incorporating an anvil 95. The anvil 95 would be spaced from tool holder guide 101 by a distance less than that of the piston excursion necessary for piston 124 to impact the cylinder end 122 and under the influence of springs 105 or a solid stop, would maintain the piston oscillation mean point within safe limits.

The compensating spring means illustrated in FIG. 8 is most effective when operated in a narrow frequency range. For this reason they are best employed in association with a constant speed motor, such as an induction motor.

While the utilization of piston-cylinder resonance greatly enchances the stength of impact it may be desirable in some applications to use a non-resonance condition, both the vented cylinder of FIGS. 1 through 7 and the non-vented cylinder of FIG. 8 can be utilized in a non-resonant condition.

With all of the embodiments of the invention, it is possible to make use of the phenomena of dynamic amplification.

The action of the cylinder oscillations acts on the free piston to cause it to reciprocate or oscillate in what is termed forced oscillation. The steady state response of such a system, if the spring stiffness K is constant, may be represented by $$x/a_o = (k^2 + b^2 w_o^2)^{1/2} \, [(m w_o^2 - k^2)^2 + 6^2 \, w_o^2]^{-1/2} \sin (w_o t + \psi) \qquad (6.)$$

Where $a_o$ is the half excursion of the cylinder oscillation as induced by the connecting rods and related motor and mechanism, $m$ is the mass of the piston and shaft, $w_o$ is the frequency at which the cylinder is forced to oscillate, $b$ is the damping coefficient, and $t$ is time. (See Den Hartog, Mechanical Vibrations, McGraw Hill, 1940, pages 40, 41.)

Figure 12:
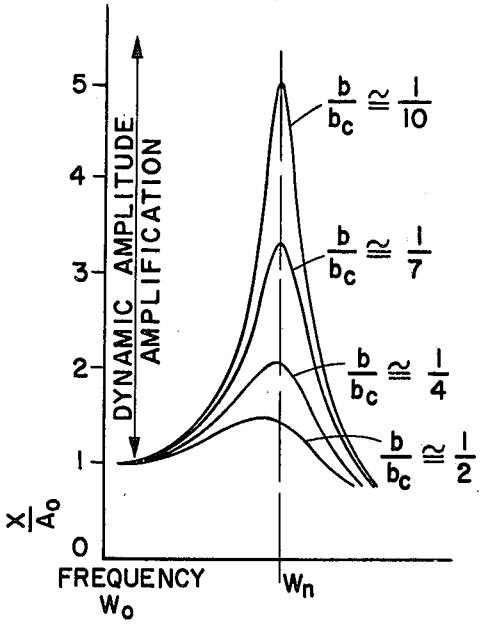
FIG. 12 is a graph of amplitude versus frequency.

A typical plot of the amplitude, that is the coefficient of sin $(w_o t + \psi)$, as it changes with $w_o$ is shown in FIG. 12 for several values of damping coefficient where $b_c$ is equal to $2(km)^{1/2}$($\psi$in Equation 6 is a phase angle showing the lag of the piston mass in radians behind the force imposed by the cylinder motion.)

It is noted that when $w_o$ is very small, $x/ao$ is nearly 1, that is, $x$ nearly equals $ao$ the piston moves with the cylinder almost as though it were attached thereto. Also for very large $w_o$, the piston motion aproaches 0. In the range of $w_o$ from about 0.2 to 1.5 of the value designated $w_n$ for usually experienced damping values, the graph shows an increase in the ratio $x/ao$. In this range, if the value of $b$ is small enough, it is noted that the response is amplified (i.e. $x$ becomes greater than $a_o$.) This is dynamic amplification. This dynamic amplification peaks at, and centers generally about, what is termed resonant frequency by those skilled in the art, and for low damping, is approximately equal to the natural frequency $w_n$ of the spring mass system.

$w_n$ is the frequency known by those versed in the art as the frequency of free vibration of the system, and may be represented to sufficient approximation by the expression $$w_n = (k/m)^{1/2} \qquad (7.)$$

The value at the peak is determined by the damping coefficient such as by the sliding friction of the piston and shaft on the cylinder and bearing, and by the work dissipated in air leakage through the piston-cylinder bearing clearance and the small stabilization vents. The spring stiffness $k$ is defined as the force per unit of excursion $x$. This is calculated by taking the derivative $dF/dx$ of the force. Based on Equation 4 for a single acting air spring, $$k = (np_i A/h)\,(1 - x/h)^{-n-1} \qquad (8.)$$

This value of $k$ is that for the slope of the curve at any particular $x/h$. The equation for a double acting air spring, $k$ is different being equal to $$(np_i A/h)\,(1 - x/h)^{-n-1} + (np_i A/h)\,(1 + x/h)^{-n-1} \qquad (9.)$$

Figure 10:
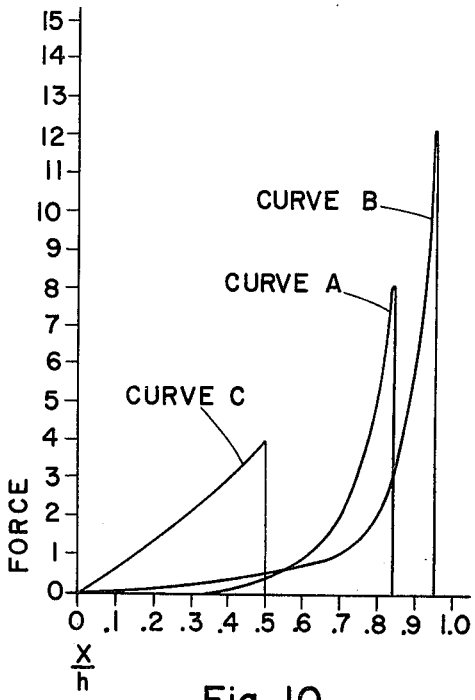
FIG. 10 is a graph of force versus $x/r$ ratio.
Figure 11:
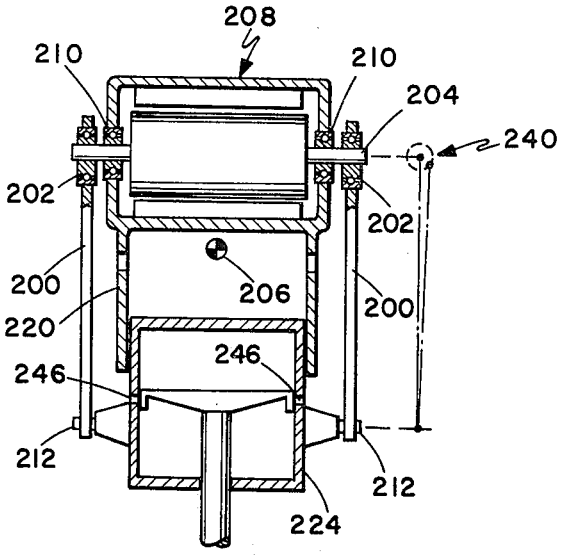
FIG. 11 is a diagrammatic sectional view of the exciter and convertor showing the center of mass.

The dynamic response Equation 6 is derived for a constant value of $k$ which does not change with $x/h$. The Equations 8 and 9 are clearly not constant with $x/h$; however, practical experience has shown that if $k$ does not depart appreciably from linearity, the effect on Equation 6 is unimportant. Hence, if the maximum $x/h$ is kept below the knee of the curve, that is in the range illustrated for the curve C in FIG. 10, then the Equation 6 can be used with sufficient accuracy by using an average value of $k$ obtained by taking an average slope of the curve of force versus $x/h$ over the range from $x/h$ equals 0 to the maximum $x/h$.

It is observed for the double air spring, the initial slope is twice that for the single acting spring. With the spring constant determined, all of the necessary factors are available to select the structure for the piston-cylinder to have appropriate dynamic amplification and impact velocity at the selected impact frequency. The cylinder length is selected to give an $z/h$ ratio less than 0.7 and the piston cross-sectional area and crank radius to give a stopping distance and accelerating capability so that the $x/h$ remains within the substantially linear portions of the curve.

After the operating frequency has been selected by reference to the desired rate of impact and the power available, the mean pressure $p$ of the cylinder (usually atmospheric), the area A of the piston or cylinder cross-section, the average value of $h$, the average open cylinder height on one side of the piston, and the mass m of the piston plus shaft, are structured so that the natural frequency of the air spring mass system is greater than 0.75 of the operating frequency.

Figure 13:
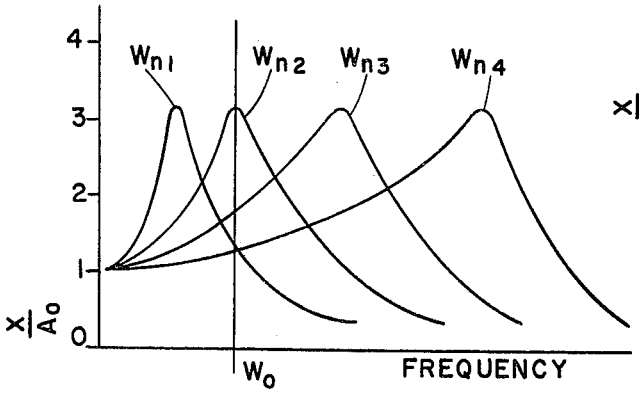
FIG. 13 is a graph of several natural frequency curves.

FIG. 13 illustrates several curves with different natural frequencies, but all with the same damping coefficient. These different curves result from forming the structural elements to provide a specific but each with a different natural frequency so that the respective curve intersects the operating frequency ordinate at a point greater than 1. By forming the structural components which make up the air spring mass system so that the natural frequency is greater than 0.75 of the operating frequency, the foregoing dynamic amplification is obtained.

Having described my invention, I now claim.

1. An impact device comprising:

a frame, a crankshaft rotatably mounted on said frame, exciter means operatively mounted to rotate said crankshaft, a body mounted for reciprocation along a selected straight path on said frame, at least two connecting rods operatively connected to said crankshaft in a spaced relation for actuation thereby in substantially the same rotational phase and operatively connected to reciprocate said body along said selected path upon rotation of said crankshaft, ram means mounted on said body and free for reciprocation relative thereto substantially parallel to reciprocation of the body, resilient means interposed between said body and said rams means for converting reciprocating motion of said body to impacting motion of said ram means, impact tool means operatively mounted on said frame for impact by said ram means during each reciprocation thereof, reciprocative guide means operatively interposed between said frame and said body and comprising a body guide element and a frame guide element and guiding said body in substantially linear reciprocation along said selected path substantially free of extraneous rotations from torques imposed on the body by angular thrust of the connecting rods, said body guide element operatively engages the frame guide element at least at one point closer to the axis of said crankshaft than the location with respect to said crankshaft of the end of said at least two connecting rods which is more remote from said axis with said end in the most remote position from said axis during operation.

2. An impact device comprising:

a frame, a crankshaft rotatably mounted on said frame, exciter means operatively mounted to rotate said crankshaft, a body mounted for reciprocation along a selected straight path on said frame, at least two connecting rods operatively connected to said crankshaft in a spaced relation for actuation thereby in substantially the same rotational phase and operatively connected to reciprocate said body along said selected path upon rotation of said crankshaft, ram means mounted on said body and free for reciprocation relative thereto substantially parallel to reciprocation of the body, resilient means interposed between said body and said ram means for converting reciprocating motion of said body to impacting motion of said ram means, impact tool means operatively mounted on said frame for impact by said ram means during each reciprocation thereof, non-rotative guide means operatively interposed between said frame and said body and guiding said body in substantially linear reciprocation along said selected path substantially free of extraneous rotations from torques imposed on the body by angular thrust of the connecting rods from differences in manufacturing tolerances, and structural deflections and oscillations, of said crankshaft, cranks, connecting rods, body, and frame during operation of said device, said non-rotative guide means comprises substantially straight line track means rotationally asymmetric and substantially parallel with respect to the selected path of body reciprocation and at least one track engaging element mounted for guided engagement with the track means during body reciprocation, the track means and the track engaging element being mounted one to the frame, and one to the body.

3. An impact device comprising:

a frame, a crankshaft rotatably mounted on said frame, exciter means operatively mounted to rotate said crankshaft, a body mounted for reciprocation along a selected straight path on said frame, at least two connecting rods pivoted on one or more cranks in a spaced relation for actuation thereby in substantially the same rotational phase at substantially the same crank radius and operatively connected to reciprocate said body along said selected path upon rotation of said crankshaft, ram means mounted on said body and free for reciprocation relative thereto substantially parallel with said selected path, resilient means interposed between said body and said ram means for converting reciprocating motion of said body to impacting motion of said ram means, impact tool means operatively mounted on said frame for impact by said ram means during reciprocation thereof, said impact tool means having a principal tool axis substantially aligned with the direction of impacting motion of said ram, at least one of said at least two connecting rods pivoted on said body on each side of said principal tool axis, the pivot axis of each said connecting rod substantially aligned with a common pivot axis, reciprocative guide means operatively interposed between said frame and said body and comprising a body guide element and a frame guide element and guiding said body substantially along said selected straight path, said body guide element operatively engages the frame guide element at least at one point closer to the axis of said crankshaft than said common pivot axis, and at least at a second point farther from the axis of said crankshaft than said common pivot axis.

4. An impact device as claimed in claim 3 further comprising:

at least one counterweight for each crank carried on said crankshaft, and having a center of mass positioned at sufficient radial distance from said crankshaft to counteract the off-axis mass of each crank and the effective off-axis mass of each connecting rod operatively connected thereto plus the average oscillatory torque of said frame induced by angular positioning of said connecting rods under reactive loads.

5. An impact device comprising:

a frame, a crankshaft rotatably mounted on said frame, exciter means operatively mounted to rotate said crankshaft, a body mounted for reciprocation on said frame, at least two connecting rods connected to said crankshaft in a spaced relation for actuation thereby in substantially the same rotational phase and operatively connected to reciprocate said body upon rotation of said crankshaft, ram means mounted on said body and free for reciprocation relative thereto substantially parallel to reciprocation of the body, resilient means interposed between said body and said ram means for converting reciprocating motion of said body to impacting motion of said ram means.

impact tool means operatively mounted on said frame for impact by said ram means during each reciprocation thereof, non-rotative guide means acting between said frame and said body for restricting the reciprocative motion of said body to substantially linear reciprocation substantially free of extraneous rotations, at least two wrist pins mounted in spaced relation on said reciprocating body, the axis of each wrist pin being substantially aligned to a common axis, said ram means having a principal axis substantially aligned with the direction of the impacting motion of said ram means, said wrist pins being laterally spaced, one wrist pin being on one side of the principal axis, and another wrist pin being on the opposite side.

at least one connecting rod pivoted on each wrist pin, and the substantially common axis of said wrist pins is located at a longitudinal position on said body between the longitudinal mid-point and the end of said body more distant from said crankshaft, said positioning of said wrist pins acting to stabilize the motion of the body and the ram means during reciprocation thereof.

6. An impact device comprising:

a frame, a crankshaft rotatably mounted on said frame, exciter means operatively mounted to rotate said crankshaft, a body mounted for reciprocation along a selected straight path on said frame, at least two connecting rods operatively connected to said crankshaft in a spaced relation for actuation thereby in substantially the same rotational phase and operatively connected to reciprocate said body along said selected path upon rotation of said crankshaft, ram means mounted on said body and free for reciprocation relative thereto substantially parallel to reciprocation of the body, resilient means interposed between said body and said ram means for converting reciprocating motion of said body to impacting motion of said ram means, impact tool means operatively mounted on said frame for impact by said ram means during each reciprocation thereof, reciprocative guide means operatively interposed between said frame and said body and comprising a body guide element and a frame guide element and guiding said body in linear reciprocation substantially along said selected straight path, said exciter means comprises a rotary motor having a rotor mounted on said frame for rotation about a selected rotational axis substantially at right angles to said selected straight path, the positioning of motor, crankshaft, and connecting rods eliminates extraneous oscillatory rotations of said crankshaft about an axis parallel with said selected straight path from pulsating torque imposed on said rotor from reaction force impulses in said connecting rods during operation.

7. An impact device as claimed in claim 6 wherein the connecting rods are pivoted on anti-friction bearings on one or more crank pins of said crankshaft and therefore develop lateral oscillatory as well as reciprocating motion.

8. An impact device as claimed in claim 6 further comprising:

said body comprising at least one structural member extending substantially diametrically across one end of said body from one side to the other, at least one said at least two connecting rods operatively connected to one side of said structural member, and another said at least two connecting rods operatively connected to the opposite side.

9. An impact device as claimed in claim 6 further comprising:

at least two cranks on said crankshaft, shaft bearing means mounted on said frame positioned closely adjacent each said crank, said ram means has a longitudinal arm axis substantially collinear with said selected straight path, said frame is positioned substantially along said longitudinal ram axis, the resultant center of mass of said frame and the components secured thereto is located substantially on said longitudinal ram axis, and said shaft bearing means are spaced on opposite sides of the point on said crankshaft which is nearest said longitudinal ram axis, such positioning of the center of mass and the longitudinal ram axis to substantially balance the impact device with respect to said ram axis and substantially reduce spurious rotations of said impact device.

10. An impact device as claimed in claim 6 wherein:

at least two cranks on said crankshaft in an axially spaced relation, at least one connecting rod pivoted on each said crank for actuation thereby at substantially the same crank radius in substantially the same rotational phase and operatively connected to reciprocate said resilient coupler means upon rotation of said crankshaft, each of said cranks comprises an eccentric having an off-center hole through which said crankshaft is pressed and keyed, said connecting rods have terminal bearings that encircle said eccentrics, said crankshaft is mounted for rotation of said frame in spaced shaft bearings, and each of said eccentrics is located closely adjacent one of said shaft bearings, said positioning of connecting rods, eccentrics, shaft, and support bearings, transmitting all forces with minimum crankshaft bending oscillations and substantially normal to each interface between said parts of minimum generation of extraneous vibrations.

11. An impact device as claimed in claim 6 wherein:

said body comprises an enclosing wall including a cylinder portion with end elements forming a total enclosed space said resilient means comprises a selected quantity of air confined in said total enclosed space said ram means comprises a piston with at least one shaft thereon, said piston fitted in a slidable and sealable relation in said cylinder portion and having piston seal means operative to restrict air leakage past said piston, at least one shaft on said piston extending in slidable sealed relation through an associated one of said end elements, said piston thereby dividing the total enclosed space within the enclosing wall into a doubly acting air spring having two separate enclosed spaces, each of variable volume, each said separate enclosed space confining a substantially constant quantity of air therein, a resilient coupler comprises said body, said piston, and the selected quantity of air confined in said enclosing wall, flow restricting passage means for limiting compensating air flow to an amount not substantially exceeding imminent air leakage past said piston and to substantially maintain the varyingly reduced air pressure of expansion alternatingly occurring during each cycle of operation in each said separate enclosed space, thereby to substantially maintain doubly acting air spring stiffness of said resilient coupler, said flow restricting passage means comprising one or more openings through said enclosing wall at one or more selected points through which said compensating air is put alternatively into and out of each said separate enclosed space by action of said piston reciprocation to compensate past the piston seal means to stabilize the piston mid-excursion point during operation.

12. An inpact device comprising:

a frame, a crankshaft rotatably mounted on said frame, exciter means operatively mounted to rotate said crankshaft, a body mounted for reciprocation on said frame, at least two connecting rods connected to said crankshaft in a spaced relation for actuation thereby in substantially the same rotation phase and operatively connected to reciprocate said body upon rotation of said crankshaft;

ram means mounted on said body and free for reciprocation relative thereto substantially parallel to reciprocation of the body, resilient means interposed between said body and said ram means for converting reciprocating motion of said body to impacting motion of said ram means, impact tool means operatively mounted on said frame for impact by said ram means during each reciprocation thereof, non-rotative guide means acting between said frame and said body for restricting the reciprocative motion of said body to substantially linear reciprocation substantially free of extraneous rotations, said exciter means comprises a rotary motor mounted on said frame, said rotary motor having an output shaft rotatably mounted on shaft support bearings, said crankshaft comprises said output shaft.

the positioning of motor, crankshaft, and connecting rods eliminates speed reduction gears, and shafts, bearings and frame supports therefor, and all extraneous vibrations generated thereby, at least two cranks on said crankshaft, said output shaft having a shaft extension extending from each end of said rotary motor, at least one of said cranks being located on each said shaft extension, said location of crankshaft and cranks to reduce structural members, and provide better balance, reduced structural and shaft deflections and extraneous vibrations generated thereby.

13. An impact device comprising:

a frame, a crankshaft rotatably mounted on said frame, exciter means operatively mounted to rotate said crankshaft, a body mounted for reciprocation on said frame, at least two connecting rods connected to said crankshaft in a spaced relation for actuation thereby in substantially the same rotational phase and operatively connected to reciprocate said body upon rotation of said crankshaft.

ram means mounted on said body and free for reciprocation relative thereto substantially parallel to reciprocation of the body, resilient means interposed between said body and said ram means for converting reciprocating motion of said body to impacting motion of said ram means, an impact tool operatively mounted on said frame for impact by said ram means during each reciprocation thereof, reciprocative guide means acting between said frame and said body for restricting the motion of said body to substantially linear reciprocation, a counterweight mounted for reciprocating movement relative to said frame, said counterweight operatively connected to an auxiliary converter means for converting such rotary to reciprocating motion, said auxiliary converter means comprising at least one additional crank secured to said crankshaft and an auxiliary connecting rod operatively connecting each said crank to said counterweight acting to produce linear motion of said counterweight opposite that of said ram means.

14. An impact device comprising:

a frame, a crankshaft rotatably mounted on said frame, exciter means operatively mounted to rotate said crankshaft, a body mounted for reciprocation on said frame, at least two connecting rods connected to said crankshaft in a spaced relation for actuation thereby in substantially the same rotational phase and operatively connected to reciprocate said body upon rotation of said crankshaft, ram means mounted on said body and free for reciprocation relative thereto substantially parallel to reciprocation of the body, resilient means interposed between said body and said ram means for converting reciprocating motion of said body to impacting motion of said ram means, an impact tool operatively mounted on said frame for impact by said ram means during each reciprocation thereof, non-rotative guide means acting between said frame and said body for restricting the reciprocative motion of said body to substantially linear reciprocation by preventing oscillatory rotative displacement of said body by any unsymmetrical action of said connecting rods on said body generated by differences in manufacturing tolerances and structural deflections in said crankshaft, cranks, connecting rods, body, and frame, compensating spring means mounted between said motor and said body acting to produce force on said motor in a direction opposite that produced by action of said connecting rods.

15. An impact device comprising:

a frame, exciter-reciprocative means operatively mounted on said frame, and having a reciprocating output reciprocating at a working rate of impacting, a resilient coupler operatively mounted for reciprocation on said frame, said resilient coupler comprising an enclosing wall including a cylinder portion with end elements forming a total enclosed space substantially confining a selected quantity of air therein, and ram means comprising a piston with at least one shaft thereon extending in slidable sealed relation through an associated one of said end elements, said piston fitted for slidable reciprocation axially within said cylinder portion and having piston seal means operative to restrict air leakage past said piston, said piston thereby dividing the total enclosed space within the enclosing wall into separate enclosed spaces of variable volume, each said separate enclosed space confining a substantially constant quantity of air therein, said resilient coupler operatively interconnecting said reciprocating output and the ram means to transmit reciprocating motion of said reciprocating output to reciprocating motion of said ram means, impact tool means operatively mounted on said frame for impact by said ram means during each reciprocation thereof, flow restricting passage means for limiting compensating air flow to an amount not substantially exceeding imminent air leakage past said piston and to substantially maintain the varyingly reduced air pressure of expansion alternatingly occurring during each cycle of operation in each said separate enclosed space, thereby to substantially maintain doubly acting air spring stiffness of said resilient coupler, said flow restricting passage means comprising one or more openings through said enclosing wall at one or more selected points through which said compensating air is put alternately into and out of each said separate enclosed space by action of said piston reciprocation to compensate for air leakage past the piston seal means to stabilize the piston mid-excursion point during operation.

16. An impact device as claimed in claim 15 wherein said impact tool means is positioned for impact by said ram means during reciprocation thereof, at an average longitudinal travel position relative to said frame at which said piston unports at least a portion of said one or more openings of said passage means to permit flow into and out of the separate enclosed space opposite said shaft during reciprocation of said piston, and the piston is substantially centered over said one or more passage openings, said positioning of said impact tool means reducing attenuation of impacting velocity from air pressure build-up on the shaft side of said piston during operation of the device.

17. An impact device as claimed in claim 16 wherein:

said impact tool means further includes anvil means operatively mounted on said frame for reciprocating movement in axial alignment between said ram means and said impact tool, said anvil means acting to receive impacting energy from said ram means and to transmit said impacting energy to said impact tool.

18. An impact device as claimed in claim 15 wherein:

said flow restricting passage means comprises at least one flow restricting vent located medially of the length of said cylinder portion.

19. An impact device as claimed in claim 15 wherein:

said flow restricting passage means comprises a multiplicity of vents disposed substantially in a circumferential ring in the wall of said cylinder portion and medially of the length thereof.

20. An impact device as claimed in claim 15 further comprising:

a high strength piston, said piston comprising a web, said web having an average circumferential thickness which varies from a maximum circumferential average thickness at the attachment to said piston shaft to a minimum circumferential average thickness adjacent the walls of said cylinder.

21. An impact device as claimed in claim 15 wherein:

said piston seal means has an effective seal leakage area through which air leaks during reciprocation of said piston, and said flow restricting passage means has a flow restricting area less than three times the effective piston seal leakage area.

22. An impact device as claimed in claim 15 wherein:

said resilient coupler has spring stiffness, $k$, said at least one shaft is a ram shaft for impacting said impact tool means, the cross-sectional area, A, of said piston on the side opposite said ram shaft, the equivalent open length, $h$, where $h = V/A$ and V is the net open volume of said separate enclosed space on the side of said piston opposite said ram shaft, and $p_i$ is the average air pressure within the enclosing wall averaged over at least one cycle of operation, are limited to a combination of selected values having a ratio $p_iA/h$ which, in combination with a restricted excursion for said reciprocating output of said exciter-reciprocating means, forms a value for said spring stiffness, $k$, of said resilient coupler sufficiently high to provide substantially constant spring stiffness throughout the range of excursion, $x$, of said ram-piston and limits $x/h$ to less than 0.7, and said $k$ and a selected mass, $m$, for said ram means limit the natural frequency, $w_n$, of said resilient coupler-mass combination in relation to said working rate of impacting, $w_o$, for which said ram means is reciprocated by said exciter-reciprocative means into excursions, $x$, during operation greater than the half excursion, $a_o$, of said reciprocating output of said exciter-reciprocative means thereby inducing dynamic amplification of the motion of said ram means.

23. An impact device as claimed in claim 22 wherein:

said exciter means comprises an electric induction motor comprising an exciter means without electrical brushes thereby acting to supply greater shaft power free of the deficiencies of electrical brushes, and having a substantially constant working frequency.

24. An impact device as claimed in claim 22 wherein:

said exciter-reciprocative means comprises a crankshaft rotatably mounted on said frame, exciter means operationally mounted to drive said crankshaft in rotary motion, and converter means operatively connected to said crankshaft for converting said rotary motion to reciprocating motion, said reciprocating output comprises at least one wrist pin on said resilient coupler, said converter means comprises at least one crank on said crankshaft, a connecting rod operatively connecting said at least one crank to said at least one wrist pin for reciprocation of said resilient coupler upon rotation of said crankshaft.

25. An impact device as claimed in claim 15 wherein:

said exciter-reciprocative means comprises a crankshaft rotatably mounted on said frame, exciter means operationally mounted to drive said crankshaft in rotary motion, and converter means operatively connected to said crankshaft for converting said rotary motion to reciprocating motion, said reciprocating output comprises at least one wrist pin on said resilient coupler, said converter means comprises at least one crank on said crankshaft, a connecting rod operatively connecting said at least one crank to said at least one wrist pin for reciprocation of said resilient coupler upon rotation of said crankshaft.

26. An impact device comprising:

a frame, exciter means operatively mounted on said frame, and having a rotary motion output at working frequency, converter means operatively connected to the output of said exciter means for converting such rotary motion to reciprocating motion, a resilient coupler operatively mounted for reciprocation on said frame, said coupler comprising a cylinder with end elements forming an enclosed space, and ram means comprising a piston with shaft on one end thereof and extending in slidable and sealed relation through one of said end elements, said piston fitted for slidable reciprocation axially within said cylinder and having piston seal means operative to restrict air leakage past said piston, said piston thereby dividing the enclosed space within the cylinder into separate enclosed spaces, said resilient coupler operatively interconnecting the converter means and the ram means to transmit reciprocating motion generated by said converter means to reciprocating motion of said ram means, an impact tool operatively mounted on said frame for impact by said ram means during each reciprocation thereof, restrictive vent means in the cylinder wall and located medially of the cylinder length, through which vent means gas is bled acting to compensate for leakage past the piston and the piston shaft to stabilize the piston midexcursion point, said vent means being restricted to bleed reduced flow of gas acting to substantially maintain reduced gas pressure on the receding end of said piston, the gas pressure being reduced by the receding motion of said piston away from the cylinder medial length position, the restricted flow of gas acting to substantially maintain double gas spring stiffness.

said piston comprises a web, said web having an average circumferential thickness which varies from a maximum circumferential average thickness at the attachment point to said piston shaft to a minumum circumferential average thickness adjacent the walls of said cylinder, said piston has a flared skirt portion attached to said minimum circumferential average thickness portion of said piston and extending from said portion parallel to the axis of said piston shaft.

27. An impact device as claimed in claim 2 wherein:

said body comprises an enclosing wall including a cylinder portion with end elements forming a total enclosed space, said resilient means comprises a selected quantity of air confined in said total enclosed space, and said ram means comprises a piston with at least one shaft thereon, said piston fitted in slidable and sealable relation in said cylinder portion and having piston seal means operative to restrict air leakage past said piston, said at least one shaft on said piston extends in slidable sealed relation through an associated one of said end elements, said piston thereby dividing the total enclosed space within the enclosing wall into a double acting air spring having two separate enclosed spaces, each of variable volume, each said separate enclosed space confining a substantially constant quantity of air therein, a resilient coupler comprises said body, said piston, and the selected quantity of air confined in said enclosing wall, flow restricting passage means for limiting compensating air flow to an amount not substantially exceeding imminent air leakage past said piston and to substantially maintain the varyingly reduced air pressure of expansion alternatingly occurring during each cycle of operation in each said separate enclosed space, thereby to substantially maintain doubly acting air spring stiffness of said resilient coupler, said flow restricting passage means comprising one or more openings through said enclosing wall at one or more selected points through which said compensating air is put alternately into and out of each said separate enclosed space by action of said piston reciprocation to compensate for air leakage past the piston seal means to stabilize the piston mid-excursion point during operation.

28. An impact device as claimed in claim 2 further comprising:

said body comprising at least one structural member extending substantially diametrically across one end of said body from one side to the other, at least one said at least two connecting rods operatively connected to one side of said structural member, and another said at least two connecting rods operatively connected to the opposite side.

29. An impact device as claimed in claim 1 further comprising:

at least two cranks on said crankshaft, shaft bearing means mounted on said frame positioned closely adjacent each said crank, said ram means has a longitudinal ram axis substantially collinear with said selected straight path, said frame is positioned substantially along said longitudinal ram axis, the resultant center of mass of said frame and the components secured thereto is located substantially on said longitudinal ram axis, and said shaft bearing means are spaced on opposite sides of the point on said crankshaft which is nearest said longitudinal ram axis, such positioning of the center of mass and the longitudinal ram axis to substantially balance the impact device with respect to said ram axis and substantially reduce spurious rotations of said impact device.

30. An impact device as claimed in claim 29 further comprising:

at least two cranks on said crankshaft, and shaft bearing means mounted on said frame positioned closely adjacent each said crank, said shaft bearing means acting to support said crankshaft in rotation with no significant bending and wobbling.

31. An impact device as claimed in claim 29 wherein:

said connecting rods are operatively pivoted on said crankshaft at substantially the same crank radius, and said connecting rods have a length at least six times the substantially common radii of said cranks.

32. An impact device as claimed in claim 2 wherein:

said exciter means comprises an electric induction motor comprising an exciter means without electrical brushes thereby acting to supply greater shaft power free of the deficiencies of electrical brushes, and having a substantially constant working frequency.

33. An impact device as claimed in claim 2 wherein:

at least two cranks on said crankshaft in an axially spaced relation, at least one connecting rod pivoted on each said crank for actuation thereby at substantially the same crank radius in substantially the same rotational phase and operatively connected to reciprocate said resilient coupler means upon rotation of said crankshaft, each of said cranks comprises an eccentric having an off-center hole through which said crankshaft is pressed and keyed, said connecting rods have terminal bearings that encircle said eccentrics, said crankshaft is mounted for rotation on said frame in spaced shaft bearings, and each of said eccentrics is located closely adjacent one of said shaft bearings, said positioning of connecting rods, eccentrics, shaft, and support bearings, transmitting all forces with minimum crankshaft bending oscillations and substantially normal to each interface between said parts for minimum generation of extraneous vibrations.

34. The method of operating an impacting device of the type wherein a rotating crankshaft having at least one crank thereon actuates resilient coupler means mounted on a frame to drive ram means into impacting motion against impact tool means upon each rotation of the crankshaft, and the resilient coupler means comprises a vented cylinder with at least one end element enclosing at least one end of the cylinder, with the ram means including a piston slidably mounted in the cylinder and arranged to close the vent and enclose an internal open space of variable volume in the cylinder upon each rotation of the crankshaft, wherein the method comprises:

for a selected frequency $w_o$ of crankshaft rotation and a selected mass $m$ of said ram means; providing a sufficiently short crank length and, in combination therewith, selecting the piston with sufficient cross-sectional area A normal to the path of piston motion and arranging the cylinder and vent location to enclose a substantially constant quantity of air of volume $Ah$ at pressure $p_i$ upon each enclosure of the internal open space by the piston during each cycle of crankshaft rotation to determine a ratio $p_iA/h$ providing air spring stiffness $k$ for said resilient coupler means of sufficient magnitude to limit piston travel toward said at least one end element during impacting operation to the point in piston travel at which the minimum volume of said internal open space is $0.3Ah$ thereby restricting such excursions within a range for which said air spring stiffness is substantially constant, and further providing sufficient magnitude for said air spring stiffness $k$, in combination with said selected mass $m$, to provide a magnitude of natural frequency $w_n$ of the air spring ram mass combination equal or sufficiently close to the selected frequency $w_o$ of said rotating crankshaft to insure driving said ram means during impacting operation into reciprocating excursions greater than said sufficiently short crank length thereby inducing dynamic amplification of the motion of said ram means.

* * * * *

UNITED STATES PATENT OFFICE

CERTIFICATE OF CORRECTION

Patent No. 4,014,392 Dated March 29, 1977

Inventor(s) Frederick W. Ross

It is certified that error appears in the above-identified patent and that said Letters Patent are hereby corrected as shown below:

Column 1, line 66, "device" should read --devices--.
Column 2, line 54, "asecondary" should read --secondary--.
Column 3, line 38, "in" should read --if--.
Column 3, line 58, "the", first occurrence, should read --to--.
Column 4, equation 5., that portion of the equation reading "$T_1$" should read the same as "$T_1$" in column 4, line 66.
Column 5, line 37, "exicter" should read --exciter--; line 41, "exicitation" should read --excitation--; line 59, "eccentries" should read --eccentrics--.
Column 6, line 42, "$L/r_3$" should read --$L/r_c$--.
Column 9, line 1, "plane" should read --plan--; line 7, "x/r" should read --x/h--; line 21, "smilary" should read --similarly--.

UNITED STATES PATENT OFFICE

CERTIFICATE OF CORRECTION

Patent No. 4,014,392 Dated March 29, 1977

Inventor(s) Frederick W. Ross Page 2 of 2

It is certified that error appears in the above-identified patent and that said Letters Patent are hereby corrected as shown below:

Column 12, equation (6.), that portion of the equation reading "$6^2$ $w_o^2$" should read --$b^2$ $w_o^2$--; lines 29, 30, and 35, each occurrence, "ao" should read --$a_o$--; equation (9.), that portion of the equation reading "'$np_iA/h$)" should read --($np_iA/h$)--; line 10, "K" should read --k--.

Column 13, line 16, "z/h" should read --x/h--.
Column 15, line 54, claim 5, the period "." should read --,--.
Column 16, line 2, the period "." should read --,--.
Column 17, line 36, claim 10, after "parts", "of" should read --for--.
Column 18, line 4, claim 11, "alternatively" should read --alternately--.
Column 18, line 6, claim 11, after "compensate" insert --for air leakage--.
Column 18, line 17, claim 12, "rotation" should read --rotational--.
Column 18, line 38, claim 12, the period "." should read --,--.
Column 18, line 61, claim 13, the period "." should read --,--.
Column 20, line 62, claim 20, after "having" "n" should read --an--.
Column 22, line 41, claim 26, the period "." should read --,--.
Column 23, line 32, claim 29, reference numeral "1" should read --2--.
Column 17, line 1, claim 9, "arm" should read --ram--.

Signed and Sealed this

Twentieth Day of December 1977

[SEAL]

Attest:

RUTH C. MASON
Attesting Officer

LUTRELLE F. PARKER
Acting Commissioner of Patents and Trademarks